US009668634B2

(12) United States Patent
Becker et al.

(10) Patent No.: US 9,668,634 B2
(45) Date of Patent: Jun. 6, 2017

(54) DISHWASHER, IN PARTICULAR DOMESTIC DISHWASHER

(71) Applicant: BSH Bosch und Siemens Hausgeräte GmbH, Munich (DE)

(72) Inventors: Martin Becker, Lauingen (DE); Daniel Delle, Bächingen (DE); Jürgen Kratzer, Dillingen (DE)

(73) Assignee: BSH Hausgeräte GmbH, Munich (DE)

( * ) Notice: Subject to any disclaimer, the term of this patent is extended or adjusted under 35 U.S.C. 154(b) by 958 days.

(21) Appl. No.: 13/945,955

(22) Filed: Jul. 19, 2013

(65) Prior Publication Data

US 2014/0028165 A1 Jan. 30, 2014

(30) Foreign Application Priority Data

Jul. 24, 2012 (DE) ..... 10 2012 213 001

(51) Int. Cl.
*A47L 15/42* (2006.01)

(52) U.S. Cl.
CPC ..... *A47L 15/42* (2013.01); *A47L 15/427* (2013.01); *A47L 15/4272* (2013.01)

(58) Field of Classification Search
CPC ..... A47L 15/4272; A47L 15/4246; A47L 15/4261; A47L 15/4268; A47L 15/4255
USPC ..... 134/56 D, 115 R, 201, 58 D, 57 D, 200, 134/114, 25.2; 312/228, 228.1, 319.2, 312/229, 237, 296, 311, 351.4, 242; 248/188.2, 188.91, 316.8, 672, 676
See application file for complete search history.

(56) References Cited

U.S. PATENT DOCUMENTS 8,231,738 B2 * 7/2012 Haeberle ..... A47L 15/4246 134/201
2012/0153786 A1 6/2012 Kücük et al.

FOREIGN PATENT DOCUMENTS

DE 202010000860 U1 * 4/2010 ..... A47L 15/4246
EP 0711527 B1 12/1998

OTHER PUBLICATIONS

Bosch, "Installation-ready appliance" Apr. 2010, DE 202010000860 U1—Machine Translation.*
Report of Examination DE 10 2012 213 001.2 dated Apr. 3, 2013.

* cited by examiner

*Primary Examiner* — David Cormier
*Assistant Examiner* — Thomas Bucci
(74) *Attorney, Agent, or Firm* — Michael E. Tschupp; Andre Pallapies

(57) ABSTRACT

A dishwasher includes a wash container for receiving items to be washed and a front frame which has an open bottom and an upper frame run and is disposed in surrounding relationship to a front loading opening of the wash container. The front frame has a cross-sectional profile and is provided with at least one height stop that projects beyond the cross-sectional profile in height and is configured as a tab in the upper frame run.

26 Claims, 4 Drawing Sheets

DISHWASHER, IN PARTICULAR DOMESTIC DISHWASHER

BACKGROUND OF THE INVENTION

The invention relates to a dishwasher, in particular a domestic dishwasher, having a wash container for receiving items to be washed, the front loading opening of which is surrounded by a front frame that is open at the bottom.

Such a dishwasher is known for example from the publication DE 44 38 085 A1. The dishwasher shown has a wash container, which is surrounded at its front loading opening by a front frame that is open at the bottom. The front frame here is welded to the wash container and has lateral bars, which abut against hinge plates in the front corner regions, said hinge plates in turn being supported in the base support at the bottom. An appliance door is hinged in a pivotable manner to the hinge plates.

A height stop is generally provided in the case of a dishwasher configured as an integrated appliance, said height stop delimiting the appliance height during the installation of a dishwasher thus configured. Any flow of force must also be kept away from a door lock of a dishwasher, as otherwise the function of the door lock and any child lock that may also be present can no longer be permanently ensured. Force absorbers and/or separate mounting brackets disposed on both sides in the corner regions of the front frame are used in the known manner as height stops. These known height stops are embodied as additional parts and can easily be removed by the person installing the dishwasher, so that their function is no longer ensured.

BRIEF SUMMARY OF THE INVENTION

It is therefore an object of the invention to further develop a dishwasher, in particular a domestic dishwasher, as known according to the preamble of the independent claim, so that the presence and function of a height stop and therefore of further components of the dishwasher, for example a door lock or the like, are permanently ensured.

According to the invention this object is achieved in that the front frame, which has a cross-sectional profile, has at least one height stop that projects beyond the cross-sectional profile in height and is configured as a tab in its upper frame run.

The inventive solution permanently allows the provision, in a dishwasher configured as an integrated appliance, of a height stop, which limits the appliance height during the installation of a dishwasher thus configured. This keeps any flow of force away from a door lock of a dishwasher permanently, so that the function of the door lock and any child lock that may also be present continues to be ensured.

In respect of limiting the appliance height as regularly as possible and in particular torque-free, it is advantageous if the upper frame run of the front frame has two height stops that project beyond the cross-sectional profile in height and are each configured as a tab, said height stops preferably being disposed with mirror symmetry in respect of a vertical plane running in particular in the center between the two lateral frame runs of the front frame. It is thus possible to limit the appliance height over the greatest possible width of the dishwasher.

The height stop, which is disposed on the upper frame run of the front frame and configured as a tab, is also preferably and favorably disposed immediately after a transition region, in particular a radius, between the adjacent lateral frame run of the front frame and the upper frame run of the front frame. This means that there is no weakening of the transition region of the front frame and the appliance height is limited over the greatest possible width of the dishwasher. Naturally the height stop, which is disposed on the upper frame run of the front frame and configured as a tab, can also be disposed at a preferably short distance from the transition region.

So that the height stop, which is disposed on the upper frame run of the front frame and configured as a tab cannot be removed easily by the person installing the dishwasher, it is preferably an integral part of the front frame, in other words configured as a single piece with the front frame. The height stop, which is configured as a tab, is therefore produced as part of the production of the front frame, again allowing an economic advantage to be achieved, not least due to the lack of assembly. The height stop is therefore not attached, in particular screwed, riveted, bonded and the like, to the front frame at a later stage.

Also the height stop, which is disposed on the upper frame run of the front frame and configured as a tab, preferably projects beyond the cross-sectional profile of the front frame in height in the region of 1 to 10 mm, preferably 1 to 8 mm, in particular 2 to 6 mm. The resulting clearance can be used to improve sound and/or heat insulation, thereby achieving operational and/or economic advantages.

To achieve optimum strength values, in particular surface inertia moments and/or torsional strength, the cross-sectional profile of the front frame preferably has a U-shape that is open to the outside with a base profile and two arms that are preferably parallel to one another. The height stop, which is disposed on the upper frame run of the front frame and configured as a tab is preferably and favorably disposed centrally between the two preferably parallel arms.

Also the height stop, which is disposed on the upper frame run of the front frame and configured as a tab, preferably has a depth, which is in the region of 20 to 90%, preferably 25 to 85%, in particular 30 to 80% of the depth of the cross-sectional profile of the front frame. The depth of the respective component by definition here extends in the depthwise direction of the dishwasher. The cited depth ranges ensure an adequate and surface-neutral configuration of the height stop and therefore the limiting of the appliance height.

The height stop, which is disposed on the upper frame run of the front frame and configured as a tab, preferably has a width in the region of 0.5 to 3.0 mm, preferably 1.0 to 2.5 mm, in particular 1.0 to 2.0 mm, and is preferably identical or approximately identical to the thickness of the cross-sectional profile, in particular a base profile of the cross-sectional profile of the front frame. The width of the respective component by definition here extends in the appliance side direction of the dishwasher. These cited width ranges also ensure an adequate and surface-neutral configuration of the height stop and therefore the limiting of the appliance height.

To achieve the greatest possible locational and positional stability, the height stop, which is disposed on the upper frame run of the front frame and configured as a tab is preferably provided with at least one bead, stiffener or the like and/or a laterally fixed clear surface in its lower transition region into the upper frame run. Such a bead or stiffener or laterally fixed clear surface is easy to produce during the production process for the height stop and it gives the height stop a substantial measure of the cited stability.

The front frame, which is open at the bottom, is also preferably connected in a releasable manner to the wash container for receiving items to be washed, preferably by means of a plurality of screw connections, latching connections or the like. This allows separation of the parts made from different materials.

The front frame, which is open at the bottom, with its lateral frame runs preferably also abuts against bearing elements, in particular hinge plates, of a base support at the bottom, as this allows simple yet also operationally reliable assembly of the dishwasher. Holders for various appliance units are provided in the base support at the bottom, it being possible to insert all of them in a releasable manner. This is also a first step toward a dishwasher, which can be easily disassembled.

Each of the two lateral frame runs of the front frame that is open at the bottom here preferably has at least one hook element, which engages around the bearing element of the base support. The hook element ensures in a simple manner that the respective frame run remains joined to the assigned bearing element, in other words the hinge plate, and also permanently provides a component-rigid double wall structure. This allows an interface point to be achieved between the front frame and the hinge plate, said interface point having a high level of component rigidity and not requiring additional separate connecting elements.

BRIEF DESCRIPTION OF THE DRAWINGS

Further features and advantages of the invention will emerge from the description of a number of preferred exemplary embodiments provided below, with reference to the accompanying figures,
in which.

DETAILED DESCRIPTION OF EXEMPLARY EMBODIMENTS OF THE PRESENT INVENTION

Figure 1:
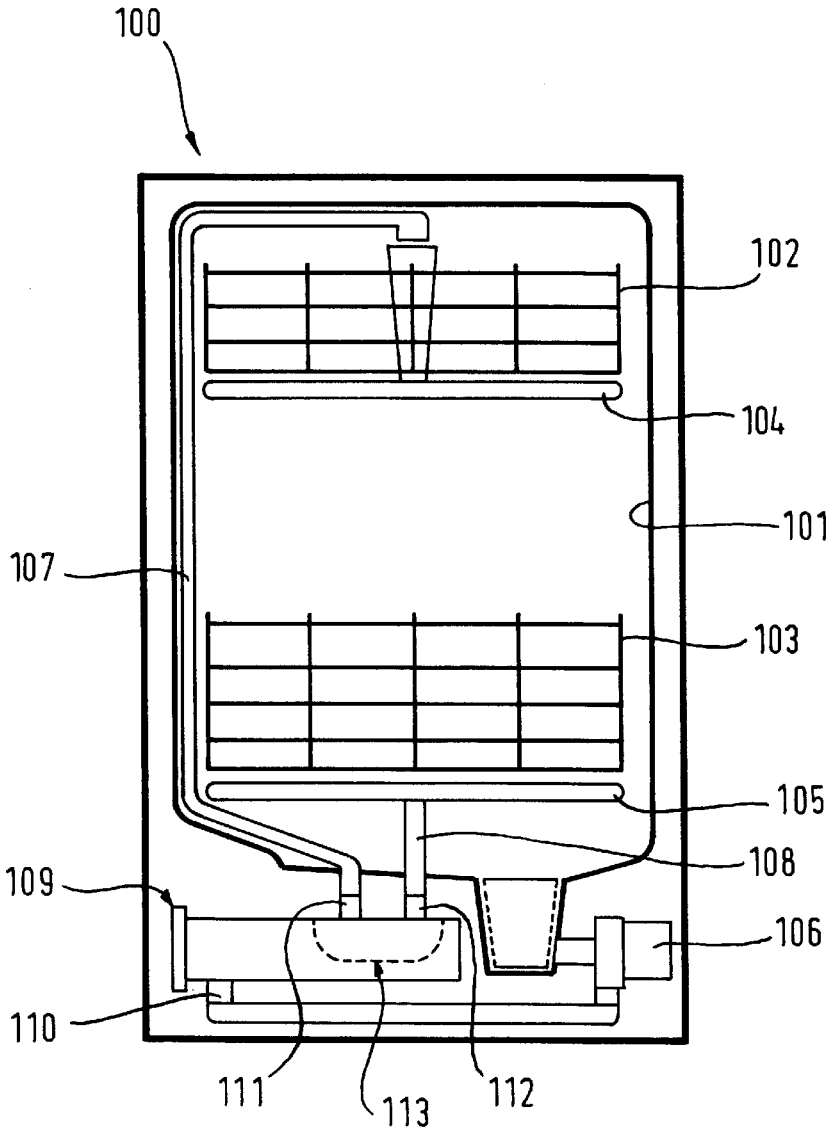
FIG. 1 shows a schematic sectional diagram of a known dishwasher.

Identical elements or components and elements or components of identical function or effect are shown with the same reference characters in the figures. Only those components of the dishwasher that are of significance for an understanding of the invention are provided with reference characters and explained. However an inventive dishwasher can of course also have further components or modules.

FIG. 1 shows a schematic sectional diagram of a known dishwasher 100, in particular a domestic dishwasher.

The illustrated dishwasher 100 has a wash container 101 for receiving items to be washed, which can be arranged for example in an upper rack 102 and a lower rack 103. Disposed in the wash container 101 are at least two spray apparatuses for applying a fluid, generally referred to as the wash liquor, to the items to be washed. In the present exemplary embodiment the spray apparatuses are configured as upper and lower spray arms 104, 105. The fluid can be conveyed by a circulating pump 106 by way of a first fluid supply line 107 to the upper spray arm 104 and by way of a second fluid supply line 108 to the lower spray arm 105. The circulating pump 106 is driven for example by an electric drive (not shown in further detail), in particular by its electric motor.

In a program sub-step of a wash program of the dishwasher 100 at least the fluid can be heated by a continuous flow heater 109, which is connected by an input connector 110 to the circulating pump 106 and by output connectors 111, 112 to the fluid supply lines 107, 108. The number of output connectors 111, 112 corresponds to the number of spray arms 104, 105 or simultaneously operated sets of spray arms 104, 105. The fluid conveyed by the circulating pump 106 is thus conducted to the input connector 110 of the continuous flow heater 109 and from the latter's output connectors 111, 112 by way of the fluid supply lines 107, 108 to the spray arms 104, 105.

The illustrated dishwasher 100 also has a water switch 113, which is disposed for example in the continuous flow heater 109 or molded thereto. The water switch 113 can however also be disposed alone per se in the dishwasher 100 for example or be connected directly to the circulating pump 106. The water switch 113 can be used to supply the spray arms 104, 105 alternately and/or continuously with the fluid, as achieved by opening one fluid outlet and closing another fluid outlet of the water switch 113.

Figure 2:
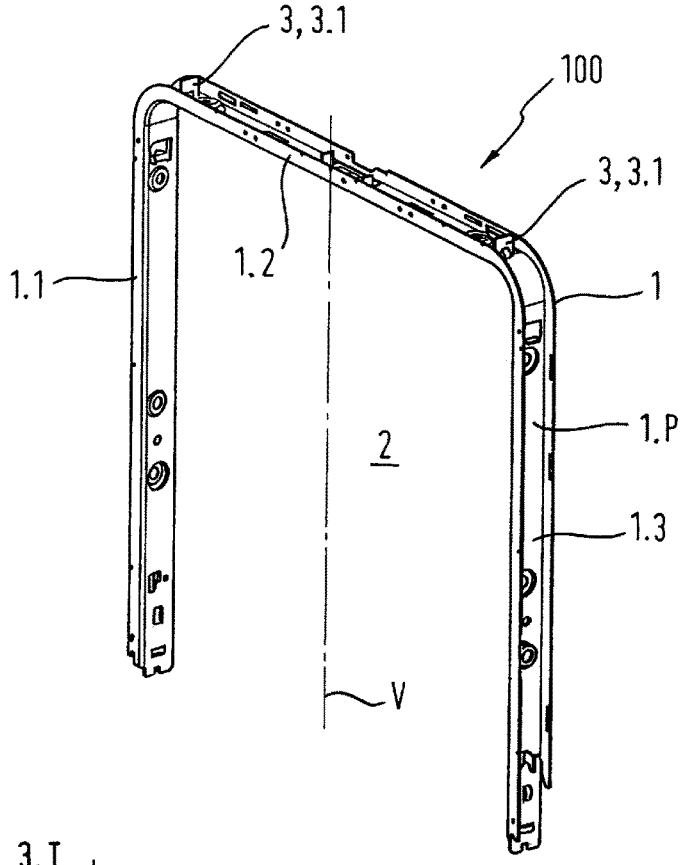
FIG. 2 shows a schematic perspective diagram of a preferred first embodiment of a front frame of an inventive dishwasher.

FIG. 2 shows a schematic perspective diagram of a preferred first embodiment of a front frame 1 of an inventive dishwasher 100, in particular an inventive domestic dishwasher.

The dishwasher 100 of this preferred first embodiment, as mentioned above, has a wash container 101 (see FIG. 1) for receiving items to be washed. An illustrated front frame 1 that is open at the bottom surrounds the front loading opening 2 of the wash container 101 of the dishwasher 100. The front frame 1 consists essentially of three frame runs: a lateral frame run 1.1 (left), an upper frame run 1.2 and a further lateral frame run 1.3 (right). The two lateral frame runs 1.1, 1.3 are preferably configured with mirror symmetry in respect of a vertical plane V running in particular in the center between the two lateral frame runs 1.1, 1.3.

The front frame 1, which has a cross-sectional profile 1.P, has at least one height stop 3 that projects beyond the cross-sectional profile 1.P in height and is configured as a tab 3.1 in its upper frame run 1.2 The tab 3.1, which is configured as a height stop 3, is produced here by means of an outward oriented mounting arrangement, in other words a mounting arrangement of the tab 3.1 from the vertical plane V toward the adjacent lateral frame run 1.3. The illustrated front frame 1 has two height stops 3, each configured as a tab 3.1. It can of course also have three, four or even more height stops each configured as a tab.

Figure 3:
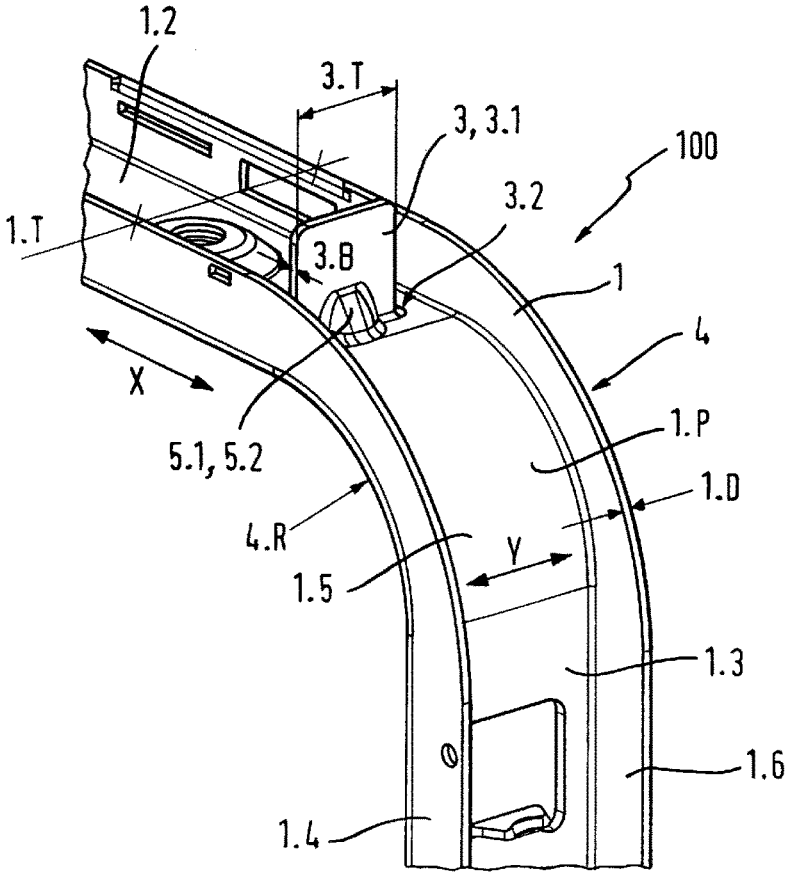
FIG. 3 shows a schematic and sectional perspective diagram of the preferred embodiment of the front frame of the inventive dishwasher shown in FIG. 2.

FIG. 3 shows a schematic and sectional perspective diagram of the preferred embodiment of the front frame 1 of the inventive dishwasher 100, in particular the inventive domestic dishwasher, shown in FIG. 2.

The front frame 1, which has a cross-sectional profile 1.P, has a height stop 3 that projects beyond the cross-sectional profile 1.P in height and is configured as a tab 3.1 on the right side of its upper frame run 1.2.

The height stop 3, which is disposed on the upper frame run 1.2 of the front frame 1 and configured as a tab 3.1, is disposed immediately after a transition region 4, in particular a radius 4.R, between the adjacent lateral frame run 1.3 of the front frame 1 and the upper frame run 1.2 of the front frame 1 and is configured as an integral part of the front frame 1, in other words as a single piece with the front frame 1.

The height stop 3, which is disposed on the upper frame run 1.2 of the front frame 1 and configured as a tab 3.1, also projects beyond the cross-sectional profile 1.P of the front frame 1 in height in the region of 1 to 10 mm, preferably 1 to 8 mm, in particular 2 to 6 mm and has a width 3.B in the region of 0.5 to 3.0 mm, preferably 1.0 to 2.5 mm, in particular 1.0 to 2.0 mm. The width 3.B of the height stop 3, which is disposed on the upper frame run 1.2 of the front frame 1 and configured as a tab 3.1, is therefore preferably identical or approximately identical to the thickness 1.D of the cross-sectional profile 1.P, in particular a base profile 1.5 of the cross-sectional profile 1.P of the front frame 1. The width 3.B of the height stop 3, which is disposed on the upper frame run 1.2 of the front frame 1 and configured as a tab 3.1, by definition here extends in the appliance side direction x (double arrow) of the dishwasher 100.

And the cross-sectional profile 1.P of the front frame 1 has a U-shape that is open to the outside with a base profile 1.5 and two arms 1.4, 1.6 that are preferably parallel to one another. The height stop 3, which is disposed on the upper frame run 1.2 of the front frame 1 and configured as a tab 3.1, is disposed centrally between the two preferably parallel arms 1.4, 1.6 (see also FIG. 4). Generally the height stop 3, which is disposed on the upper frame run 1.2 of the front frame 1 and configured as a tab 3.1, has a depth 3.T, which is in the region of 10 to 90%, preferably 25 to 85%, in particular 30 to 80% of the depth 1.T of the cross-sectional profile 1.P of the front frame 1. The depth 3.T of the height stop 3, which is disposed on the upper frame run 1.2 of the front frame 1 and configured as a tab 3.1, by definition here extends in the depthwise direction y (double arrow) of the dishwasher 100.

The height stop 3, which is disposed on the upper frame run 1.2 of the front frame 1 and configured as a tab 3.1, is also provided with an illustrated bead (stiffener) 5.1 and/or a laterally fixed free surface (not shown but known to the person skilled in the art) 5.2 in its lower transition region 3.2 into the upper frame run 1.2 of the front frame 1.

Figure 4:
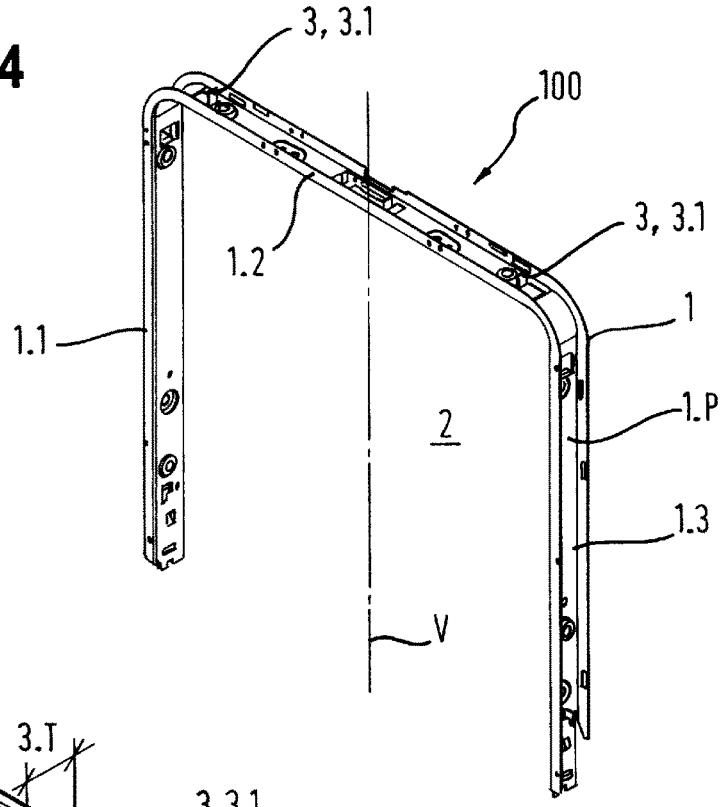
FIG. 4 shows a schematic perspective diagram of a preferred second embodiment of a front frame of an inventive dishwasher.

FIG. 4 shows a schematic perspective diagram of a preferred second embodiment of a front frame 1 of an inventive dishwasher 100, in particular an inventive domestic dishwasher.

The dishwasher 100 of this preferred second embodiment, as mentioned above, has a wash container 101 (see FIG. 1) for receiving items to be washed. An illustrated front frame 1 that is open at the bottom surrounds the front loading opening 2 of the wash container 101 of the dishwasher 100. The front frame 1 consists essentially of three frame runs: a lateral frame run 1.1 (left), an upper frame run 1.2 and a further lateral frame run 1.3 (right). The two lateral frame runs 1.1, 1.3 are preferably configured with mirror symmetry in respect of a vertical plane V running in particular in the center between the two lateral frame runs 1.1, 1.3.

The front frame 1, which has a cross-sectional profile 1.P, has at least one height stop 3 that projects beyond the cross-sectional profile 1.P in height and is configured as a tab 3.1 in its upper frame run 1.2. The tab 3.1, which is configured as a height stop 3, is produced here by means of an inward oriented mounting arrangement, in other words a mounting arrangement of the tab 3.1 from the adjacent lateral frame run 1.3 toward the vertical plane V. The illustrated front frame 1 has two height stops 3, each configured as a tab 3.1. It can of course also have three, four or even more height stops each configured as a tab.

Figure 5:
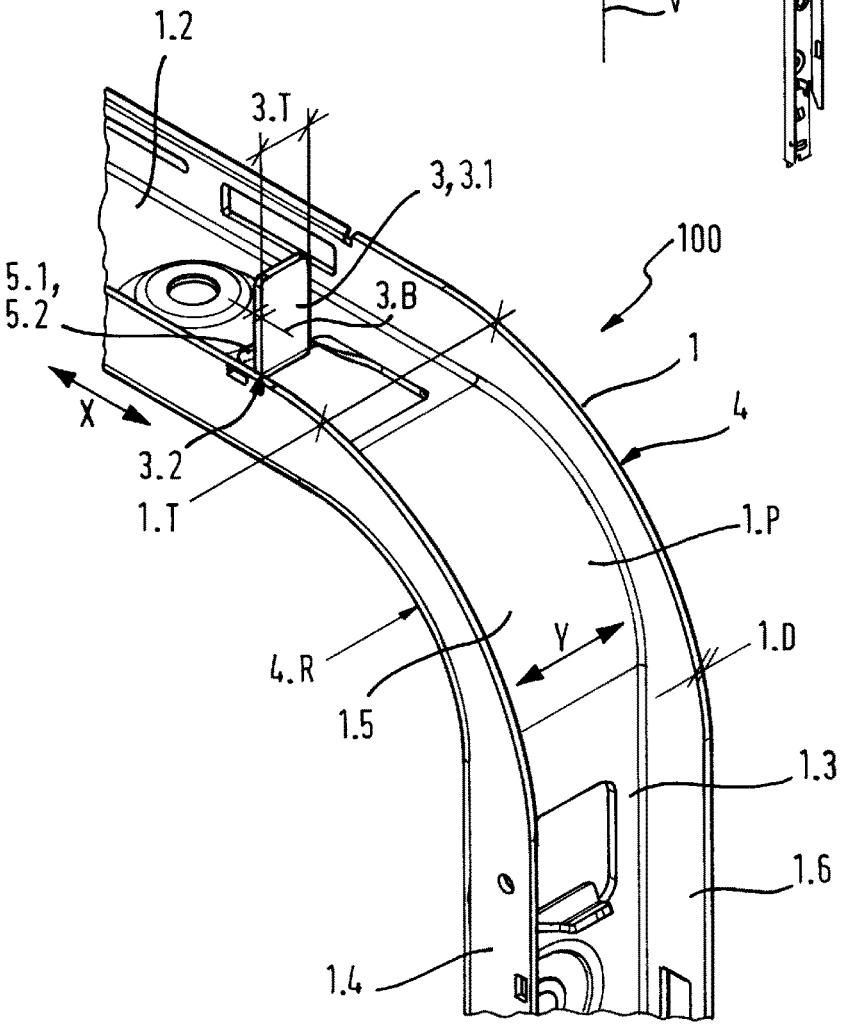
FIG. 5 shows a schematic and sectional perspective diagram of the preferred embodiment of the front frame of the inventive dishwasher shown in FIG. 4.

FIG. 5 shows a schematic and sectional perspective diagram of the preferred embodiment of the front frame 1 of the inventive dishwasher 100, in particular the inventive domestic dishwasher, shown in FIG. 4.

The front frame 1, which has a cross-sectional profile 1.P, has a height stop 3 that projects beyond the cross-sectional profile 1.P in height and is configured as a tab 3.1 on the right side of its upper frame run 1.2.

The height stop 3, which is disposed on the upper frame run 1.2 of the front frame 1 and configured as a tab 3.1, is disposed immediately after a transition region 4, in particular a radius 4.R, between the adjacent lateral frame run 1.3 of the front frame 1 and the upper frame run 1.2 of the front frame 1 and is configured as an integral part of the front frame 1, in other words as a single piece with the front frame 1.

The height stop 3, which is disposed on the upper frame run 1.2 of the front frame 1 and configured as a tab 3.1, also projects beyond the cross-sectional profile 1.P of the front frame 1 in height in the region of 1 to 10 mm, preferably 1 to 8 mm, in particular 2 to 6 mm and has a width 3.B in the region of 0.5 to 3.0 mm, preferably 1.0 to 2.5 mm, in particular 1.0 to 2.0 mm. The width 3.B of the height stop 3, which is disposed on the upper frame run 1.2 of the front frame 1 and configured as a tab 3.1, is therefore preferably identical or approximately identical to the thickness 1.D of the cross-sectional profile 1.P, in particular a base profile 1.5 of the cross-sectional profile 1.P of the front frame 1. The width 3.B of the height stop 3, which is disposed on the upper frame run 1.2 of the front frame 1 and configured as a tab 3.1, by definition here extends in the appliance side direction x (double arrow) of the dishwasher 100.

And the cross-sectional profile 1.P of the front frame 1 has a U-shape that is open to the outside with a base profile 1.5 and two arms 1.4, 1.6 that are preferably parallel to one another. The height stop 3, which is disposed on the upper frame run 1.2 of the front frame 1 and configured as a tab 3.1, is disposed centrally between the two preferably parallel arms 1.4, 1.6 (see also FIG. 6). Generally the height stop 3, which is disposed on the upper frame run 1.2 of the front frame 1 and configured as a tab 3.1, has a depth 3.T, which is in the region of 10 to 90%, preferably 25 to 85%, in particular 30 to 80% of the depth 1.T of the cross-sectional profile 1.P of the front frame 1. The depth 3.T of the height stop 3, which is disposed on the upper frame run 1.2 of the front frame 1 and configured as a tab 3.1, by definition here extends in the depthwise direction y (double arrow) of the dishwasher 100.

The height stop 3, which is disposed on the upper frame run 1.2 of the front frame 1 and configured as a tab 3.1, is also provided with an illustrated bead (stiffener) 5.1 and/or a laterally fixed free surface (not shown but known to the person skilled in the art) 5.2 in its lower transition region 3.2 into the upper frame run 1.2 of the front frame 1.

Figure 6:
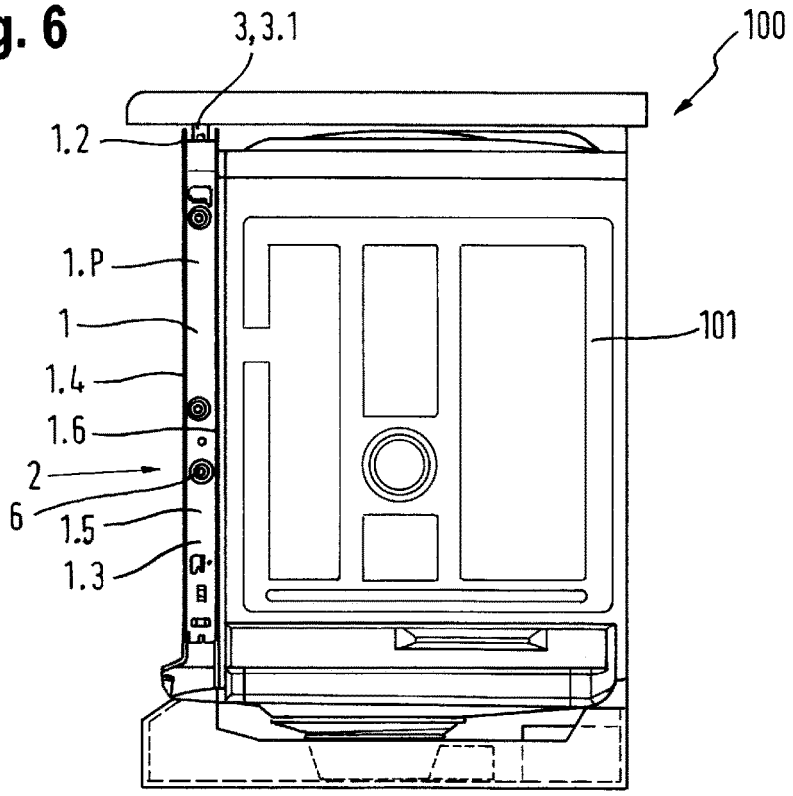
FIG. 6 shows a schematic side view of a preferred embodiment of a front frame of an inventive dishwasher.

FIG. 6 shows a schematic side view of a preferred embodiment of an inventive dishwasher 100, in particular an inventive domestic dishwasher.

The dishwasher 100, as mentioned a number of times above, has a wash container 101 for receiving items to be washed. An illustrated front frame 1 that is open at the bottom surrounds the front loading opening 2 of the wash container 101 (see FIG. 1) of the dishwasher 100. The front frame 1 consists essentially of three frame runs: a lateral frame run 1.1 (left), an upper frame run 1.2 and a further lateral frame run 1.3 (right) (see FIG. 2).

The front frame 1, which has a cross-sectional profile 1.P, has at least one height stop 3 that projects beyond the cross-sectional profile 1.P in height and is configured as a tab 3.1 in its upper frame run 1.2 The illustrated front frame 1 has two height stops 3, at a distance from one another and each configured as a tab 3.1 (see FIG. 2). It can of course also have three, four or even more height stops each configured as a tab.

And the cross-sectional profile 1.P of the front frame 1 has a U-shape that is open to the outside with a base profile 1.5 and two arms 1.4, 1.6 that are preferably parallel to one another. The height stop 3, which is disposed on the upper frame run 1.2 of the front frame 1 and configured as a tab 3.1, is disposed centrally between the two preferably parallel arms 1.4, 1.6.

The front frame 1, which is open at the bottom, is connected in a releasable manner to the wash container 101 for receiving items to be washed, preferably by means of a plurality of screw connections 6, latching connections or the like (only indicated).

Figure 7:
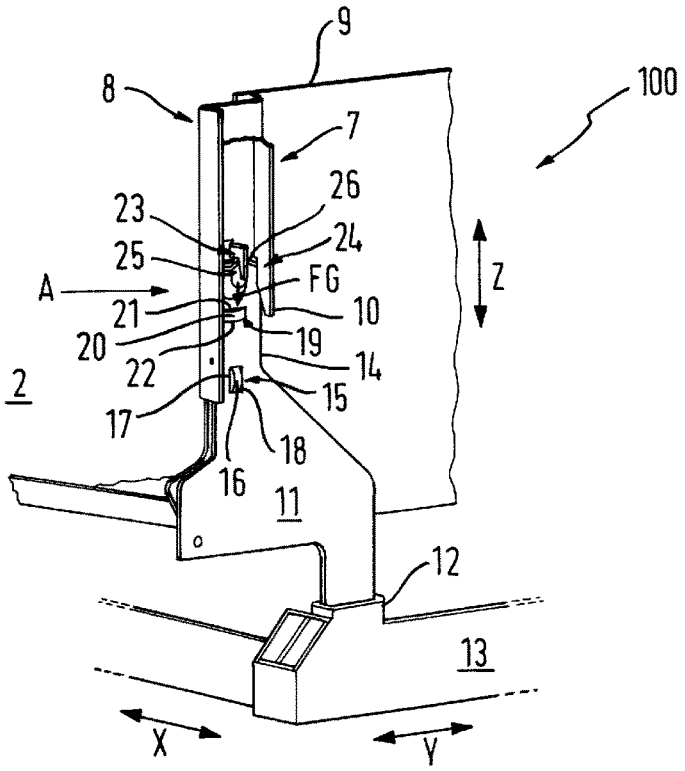
FIG. 7 shows a schematic perspective diagram of a preferred embodiment of a front and right-hand corner region of a support structure of an inventive dishwasher.

FIG. 7 shows a schematic perspective diagram of a preferred embodiment of a front and right-hand corner region 7 of a support structure 8 of an inventive dishwasher 100, in particular an inventive domestic dishwasher, the outer housing and appliance door of which have been omitted. Appliance components which do not contribute to an understanding of the invention are also omitted from FIG. 7 for the sake of clarity. The left lower front corner region (not shown) is embodied with mirror symmetry in respect of a vertical center axis.

The dishwasher 100 has a box-shaped wash container 9, which can be made from sheet metal plates welded together and has a front loading opening 2, which can be closed off by the appliance door. The front loading opening 2 of the wash container 9 is surrounded in the known manner by a front frame 1, which is welded to the outside of the wash container 9 as a support element. The front frame 1 has lateral frame runs 1.1, 1.3, which are connected at the top to an upper frame run 1.2 (see FIG. 2). The front frame 1 is embodied with a U-shaped profile having a base profile 1.5 and laterally outward arms 1.4, 1.6 (see FIG. 3). The loading opening 2 is not enclosed completely by the front frame 1; instead the lateral frame runs 1.1, 1.3 have ends 10 that are free at the bottom and abut against hinge plates 11. These are inserted respectively into a mounting shaft 12 of a trough-type base support 13. The base support 13 also has bearing contours (not shown in detail) on its rear corner regions, supporting the wash container 9 in the rear region. Hinge levers (not shown) are also hinged to the outside of the two hinge plates 11 in the appliance side direction x (double arrow), being mounted on the appliance door.

An interface point A is disposed between the lateral frame run 1.3 of the front frame 1 and the hinge plate 11. The hinge plate 11 therefore has a hinge plate arm 14 projecting vertically upward, which is preferably disposed between the two peripheral flanges 12 of the lateral frame run 1.3. Window-type cutouts 15, 19 are incorporated in the vertical hinge plate arms 14 of the hinge plate 11, with a depth stop 16 and a height stop 20 of the lateral frame run 1.3 being inserted therein. The depth and height stops 16, 20 are embossed in the base segment 11 of the lateral frame run 1.3. The depth stop 16 interacts in the depthwise direction y (double arrow) with the vertical peripheral edges 17, 18 of the cutout 15 with almost no clearance. In contrast the height stop 20 interacts with the horizontal peripheral edges 21, 22 of the upper cutout 19. The wash container 9 therefore abuts with its weight force FG over the two lateral height stops 20 against the lower peripheral edge 22 of the upper cutout 19 in the vertical hinge plate arm 14, with the result that the weight force FG is induced into the hinge plate 11. Any overlap between the height stop 20 and the lower peripheral edge 22 of the cutout 15 is relatively small and amounts to around 3 to 7 mm depending on sheet thickness. The same is true of the overlap provided in the depthwise direction y (double arrow) between the depth stop 16 and the lateral vertical peripheral edges 17, 18. In order to ensure permanent engagement of the height/depth stops, the lower end 10 of the lateral frame run 1.3 is configured with additional hook elements 23, 24, which each have a centering gap 25 that is open at the bottom in the heightwise direction z (double arrow), into which the top edge 26 of the vertical hinge plate arm 14 is inserted. Therefore both the hook element 23 and the hook element 24 engage respectively over the top edge 26 of the vertical hinge plate arm 14. The centering gap 25 here is designed so that the vertical hinge plate arm 14 is in close contact with the base segment 11 of the lateral frame run 1.3.

The configurations and developments of the invention described above and/or set out in dependent claims can, except in instances of clear dependencies or inconsistencies, be applied individually or in any combination with one another.

To summarize, it should be noted that the object of the invention is to further develop a dishwasher, in particular a domestic dishwasher, as known according to the preamble of the independent claim, so that the presence and function of a height stop and therefore of further components of the dishwasher, for example a door lock or the like, are permanently ensured.

What is claimed is:

1. A dishwasher, comprising:

a wash container for receiving items to be washed, said wash container having a front loading opening; and a front frame disposed in surrounding relationship to the front loading opening and having an open bottom and an upper frame run, said front frame having a cross-sectional profile and provided with at least one height stop that projects beyond the cross-sectional profile in height, wherein the at least one height stop comprises a plate-shaped tab disposed in the upper frame run, said plate-shaped tab being configured as an integral part of the front frame in a single, one-piece construction with the front frame, wherein the cross-sectional profile of the front frame has a U-shape that is open to the outside and includes a base profile and two arms, the plate-shaped tab being disposed between the two arms, and wherein the plate-shaped tab extends outwardly from the front frame with respect to the wash container.

2. The dishwasher of claim 1, constructed in the form of a domestic dishwasher.

3. The dishwasher of claim 1, wherein the upper frame run of the front frame has two height stops that project beyond the cross-sectional profile in height and are each configured as a plate-shaped tab.

4. The dishwasher of claim 3, wherein the height stops are disposed with mirror symmetry in respect of a vertical plane running in a center between two lateral frame runs of the front frame.

5. The dishwasher of claim 1, wherein the at least one height stop is disposed immediately after a transition region between an adjacent lateral frame run of the front frame and the upper frame run of the front frame.

6. The dishwasher of claim 5, wherein the transition region is defined by a radius.

7. The dishwasher of claim 1, wherein the at least one height stop is configured to project beyond the cross-sectional profile of the front frame in height in a range of 1 to 10 mm.

8. The dishwasher of claim 1, wherein the at least one height stop is configured to project beyond the cross-sectional profile of the front frame in height in a range of 1 to 8 mm.

9. The dishwasher of claim 1, wherein the at least one height stop is configured to project beyond the cross-sectional profile of the front frame in height in a range of 2 to 6 mm.

10. The dishwasher of claim 1, wherein the plate-shaped tab is disposed centrally between the two arms.

11. The dishwasher of claim 1, wherein the two arms extend in parallel relationship to one another.

12. The dishwasher of claim 1, wherein the at least one height stop has a depth in a range of 20 to 90%, of a depth of the cross-sectional profile of the front frame.

13. The dishwasher of claim 1, wherein the at least one height stop has a depth in a range of 25 to 85% of a depth of the cross-sectional profile of the front frame.

14. The dishwasher of claim 1, wherein the at least one height stop has a depth in a range of 30 to 80% of a depth of the cross-sectional profile of the front frame.

15. The dishwasher of claim 1, wherein the at least one height stop has a width which is identical or approximately identical to a thickness of the cross-sectional profile.

16. The dishwasher of claim 15, wherein the width of the at least one height stop is identical or approximately identical to a thickness of a base profile of the cross-sectional profile of the front frame.

17. The dishwasher of claim 15, wherein the width is in a range of 0.5 to 3.0 mm.

18. The dishwasher of claim 15, wherein the width is in a range of 1.0 to 2.5 mm.

19. The dishwasher of claim 15, wherein the width is in a range of 1.0 to 2.0 mm.

20. The dishwasher of claim 1, wherein the at least one height stop is provided with at least one bead or a stiffener in a lower transition region into the upper frame run of the front frame.

21. The dishwasher of claim 1, wherein the at least one height stop is provided with at least one laterally fixed free surface in a lower transition region into the upper frame run of the front frame.

22. The dishwasher of claim 1, further comprising fasteners for releasably connecting the front frame to the wash container for receiving items to be washed.

23. The dishwasher of claim 22, wherein the fasteners include screw connections or latching connections.

24. The dishwasher of claim 1, further comprising bearing elements, said front frame having two lateral frame runs for support upon the bearing elements.

25. The dishwasher of claim 24, wherein the bearing elements are configured as hinge plates of a bottom-side base support.

26. The dishwasher of claim 24, wherein the two lateral frame runs of the front frame have each at least one hook element for engagement around the bearing elements.

* * * * *